US006166363A

United States Patent [19]

Shon et al.

[11] Patent Number: 6,166,363

[45] Date of Patent: Dec. 26, 2000

[54] DEFROSTING METHOD FOR A MICROWAVE OVEN

[75] Inventors: Jong-chull Shon; Bo-in Jang; Dong-bin Lim, all of Suwon; Won-woo Lee, Ansan, all of Rep. of Korea

[73] Assignee: SamSung Electronics Co., Ltd., Suwon, Rep. of Korea

[21] Appl. No.: 09/481,518

[22] Filed: Jan. 12, 2000

[30] Foreign Application Priority Data

Jan. 14, 1999 [KR] Rep. of Korea ..... 99-762
Jul. 7, 1999 [KR] Rep. of Korea ..... 99-27331

[51] Int. Cl.[7] ..... H05B 6/68

[52] U.S. Cl. ..... 219/703; 219/704; 219/709; 219/754; 99/325; 426/243

[58] Field of Search ..... 219/703, 704, 219/709, 754, 707; 99/325; 426/243, 524

[56] References Cited

U.S. PATENT DOCUMENTS

| | | | |
|---|---|---|---|
| 4,210,795 | 7/1980 | Lentz | 219/703 |
| 5,436,433 | 7/1995 | Kim et al. | 219/703 |
| 5,519,194 | 5/1996 | Gong | 219/703 |

FOREIGN PATENT DOCUMENTS

| | | | |
|---|---|---|---|
| 3-95314 | 4/1991 | Japan | 219/709 |
| 3-219587 | 9/1991 | Japan | 219/709 |

*Primary Examiner*—Philip H. Leung
*Attorney, Agent, or Firm*—Robert E. Bushnell, Esq.

[57] ABSTRACT

A defrosting method for a microwave oven capable of variably adjusting a level of output power of a magnetron in accordance with data detected from a sensor, comprising the steps of (a) detecting a change degree of output data from a sensor for a predetermined time period; and (b) adjusting a level of output power of a magnetron in accordance with the change degree of the output data from the sensor.

16 Claims, 14 Drawing Sheets

DEFROSTING METHOD FOR A MICROWAVE OVEN

This application makes reference to, incorporates the same herein, and claims all benefits accruing under 35 U.S.C §119 from an applications, CONTROL METHOD OF A MICROWAVE OVEN WITH A DEVICE FOR DETECTING MAGNETIC FIELD OF STANDING WAVE earlier filed in the Korean Industrial Property Office on Jul. 7, 1999, and there duly assigned Serial No. 1999-27331 by that Office, and A MICROWAVE OVEN WITH A DEVICE FOR DETECTING MAGNETIC FIELD OF STANDING WAVE AND ITS METHOD earlier filed in the Korean Industrial Property Office on Jan. 14, 1999, and there duly assigned Serial No. 1999-762 by that Office, a copy of which applications is annexed hereto and simultaneously filed herewith.

BACKGROUND OF THE INVENTION

1. Field of the Invention

The present invention relates to a defrosting method for a microwave oven, and more particularly to a defrosting method for a microwave oven capable of detecting defrosting status of an object in the microwave oven, and for variably adjusting output power of a magnetron based on the detected data.

2. Description of the Prior Art

Generally, a microwave oven performs cooking operation by radiating microwaves generated from a magnetron onto food, which is a dielectric substance, in the microwave oven. That is, the microwaves collide molecules in the food and generate fictional heat for heating the food.

Such a microwave oven is provided with a defrosting function for defrosting frozen food properly, in addition to other cooking functions such as baking, boiling, etc.

When defrosting the food, the frozen food is placed in a cooking chamber of the microwave oven, and weight of the food is inputted, and then a controlling part of the microwave oven adjusts output power of the microwaves generated from the magnetron in accordance with data of inputted weight of the food to defrost the food.

If a user inputs his/her desired defrosting time for the food placed in the cooking chamber of the microwave oven, the controlling part of the microwave oven drives the magnetron for the user's inputted time with output power corresponding to the user's inputted time for defrosting the food.

With the defrosting function of the conventional microwave oven, however, there is a problem in that the user has to input the exact weight of the food to defrost the food properly. Since the user does not always input the exact weight of the food, it often occurs that the food does not properly defrost but under-defrost or over-defrost.

Further, even though the user inputs the exact weight of the food, and the microwave oven performs the defrosting with the output power corresponding to the inputted weight, since the frozen status of the food varies respectively, the proper defrosting of food can not be fully guaranteed.

Further, when the user inputs the defrosting time by himself/herself, the user usually sets the defrosting time by his/her guesswork, preference, or based on his/her experience, the proper defrosting of food can not be fully guaranteed.

Further, since the microwave oven always performs the defrosting operation with the uniform degree of output power of the magnetron, there is a problem that the output power can not be adjusted to correspond to the changing defrosting status of the food as the time progresses. Further, there is inconvenience in that, during the defrosting operation, the only way to check the defrosting status of the food for the user is that the user takes a look at the food in the cooking chamber for determining whether he/she has to increase/decrease the defrosting time, or to perform the additional defrosting operation when the defrosting is completed.

SUMMARY OF THE INVENTION

The present invention has been developed to overcome the above-mentioned problem and disadvantage of the prior art, and accordingly, it is an object of the present invention to provide a defrosting method for a microwave oven capable of variably adjusting output power of magnetron based on differences between detected data of frozen food which is detected by a sensor.

Another object of the present invention is to provide a defrosting method for a microwave oven for calculating a magnetron output power adjusting range in which differences between detected data from a sensor fall, and for determining a proportion of magnetron output power adjustment in accordance with the outputted adjusting range.

Yet another object of the present invention is to provide a defrosting method for a microwave oven for determining a weight of the food by comparing slopes of curves of detected data varying according to the time progress, and for calculating a defrosting completion time in accordance with the determined weight of the food.

Yet another object of the present invention is to provide a defrosting method for a microwave oven not only for adjusting the output power of the magnetron but also for calculating a defrosting completion time by comparing local minimum and local maximum values of detected data from a sensor which is changing according to the time progress.

The above object is accomplished by a defrosting method for a microwave oven according to a preferred embodiment of the present invention, including the steps of: (a) detecting a change degree of output data from a sensor for a predetermined time period; and (b) adjusting a level of output power of a magnetron in accordance with the change degree of the output data from the sensor.

Preferably, the step (b) adjusts the output power of the magnetron in accordance with an absolute value of the change degree of the output data from the sensor.

More preferably, the step (b) calculates a ratio of the output data with respect to an initial output data and adjusts the level of output power of the magnetron in accordance with the ratio calculated.

Further, the step (b) calculates a magnetron output power adjust range including the change degree of the output data from the sensor therein, and adjusts the level of the power of the magnetron in accordance with the magnetron output power adjust range calculated.

Further, according to the present invention, the period that the output data are detected by the sensor is comprised of a certain number of rotations of a turntable of the microwave oven on which a food to defrost is placed, and the sensor is comprised of an antenna sensor for detecting magnetic field voltage of stationary waves of microwaves generated from the magnetron.

Meanwhile, the antenna sensor keeps detecting the output data from the magnetron from a magnetron power-on time until a magnetron power-off time, and the level of the output power of the magnetron is adjusted by controlling operation period of the magnetron by adding and subtracting magnetron power on/off periods.

The above object is also accomplished by a defrosting method for a microwave oven according to the present invention, including the steps of: (a) detecting a change degree of output data from a sensor for a predetermined time period; (b) calculating a slope of the output data detected for the predetermined time period; and (c) determining a magnetron driving completion time by comparing the slope calculated.

Preferably, the step (b) multiplies a plurality of slopes varying for the predetermined time period.

More preferably, the driving of magnetron is completed when a multiplication of the plurality of slopes is below a value of "0", while the driving of the magnetron continues with adjusted level of output power of the magnetron when a multiplication of the plurality of slopes is above a value of "0".

Further, according to the present invention, the driving of the magnetron is completed when a multiplication of the plurality of slopes equals a value of "0".

The above object is also accomplished by a defrosting method for a microwave oven according to the present invention, including the steps of: (a) detecting a change degree of output data from a sensor for a predetermined time period; and (b) determining a defrosting completion time in accordance with the change degree of the output data detected for the predetermined time period.

Preferably, the step (b) determines the magnetron driving completion time in accordance with a summation of degrees of change of the data detected for the predetermined time period.

More preferably, the step (b) calculates points for local minimum and local maximum values of the data detected for a predetermined time period, and determines the magnetron is driving completion time by the difference between the points for minimum and maximum values of the detected data.

Further, the step (b) differentiates the data detected for the predetermined time period, and obtains the minimum and maximum values, and determines the magnetron driving completion time in accordance with a difference between the minimum and maximum values calculated.

According to the microwave oven constructed as above according to the present invention, as a turntable, on which a food to defrost is placed, is rotated, magnetron power on/off periods are adjusted and a defrosting completion time is determined based on the calculation of differences between data regularly outputted from a sensor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Hereinafter, a method according to a first preferred embodiment of the present invention will be described in greater detail with reference to the accompanied drawings.

Figure 1:
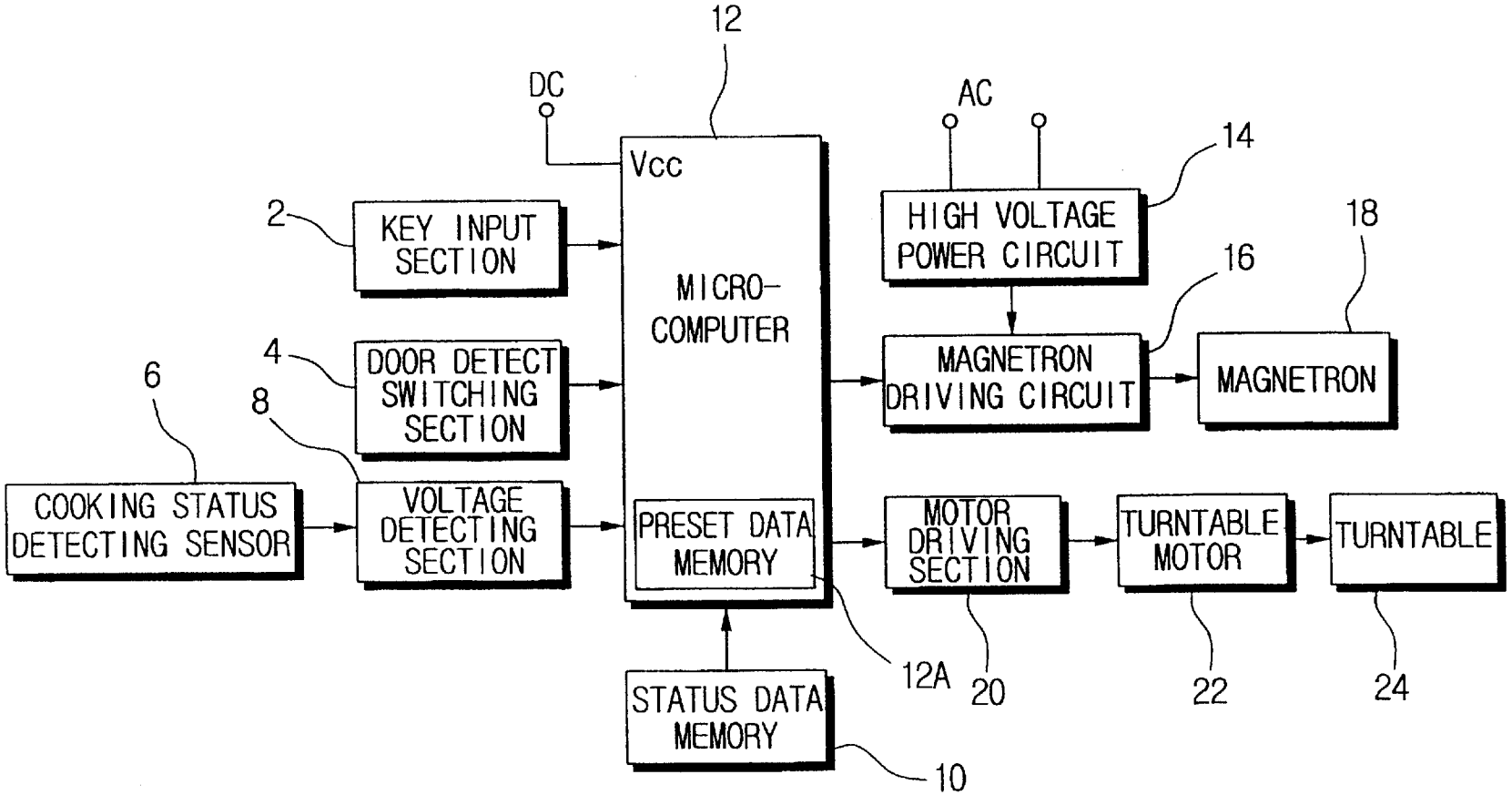
FIG. 1 is a block diagram for showing a structure of a microwave oven employing a defrosting method according to the present invention.

FIG. 1 is a block diagram for showing a structure of a microwave oven employing a defrosting method according to the present invention.

As shown in FIG. 1, the microwave oven includes a key input section 2, a door detect switching section 4, a cooking status detect sensor 6, a voltage detecting section 8, a status data memory 10, a microcomputer 12 having a preset data memory 12A, a high voltage power circuit 14, a magnetron driving circuit 16, a magnetron 18, a motor driving section 20, a turntable motor 22, and a turntable 24.

The key input section 2 includes a plurality of cooking item buttons for selecting various cooking items, a cooking execution button for executing the cooking operation, and a defrosting execution button for executing the defrosting operation. The door detect switching section 4 detects opening/closing status of a cooking chamber door of the microwave oven, and generates corresponding door detect switching signal.

The cooking status detecting sensor 6 is disposed in the cooking chamber of the microwave oven to detect the defrosting status of the food to defrost. In the embodiments of the present invention, it is preferable that the cooking status detecting sensor 6 employs an antenna sensor disposed in a waveguide of the microwave oven for detecting magnetic field voltage of stationary wave which is the combination of incident and reflected waves of the microwaves generated from the magnetron 18.

The antenna sensor is disclosed in the Korean Patent Publication No. 98-161026 entitled "High frequency heating apparatus" filed on Jun. 19, 1993 by the same applicant (assignee) of this application and published on Dec. 15, 1998, and in the Korean Utility Model Publication No. 99-143508 entitled "High frequency heating apparatus" filed on Aug. 11, 1993 by the same applicant (assignee) of this application and published on Jun. 15, 1999, in detail.

Meanwhile, the cooking status detecting sensor 6 may include a plurality of sensors such as an infared sensor and an temperature sensor for detecting temperature of food, a humidity sensor and a gas sensor for detecting water vapor and gas particles from the food, and light emitting element and light receiving element for detecting the shape of the food, etc.

Further, the voltage detecting section 8 precisely detects voltage signals from the cooking status detecting sensor 6. Here, if the cooking status detecting sensor 6 is formed of the antenna sensor, the voltage detecting section 8 includes a diode for rectifying the voltage of the magnetic field of stationary wave induced at the antenna sensor, a smoothing capacitor for smoothing the rectified voltage, and a resistor.

Meanwhile, in the status data memory 10, defrosting status detecting data which is a result of regular detection of the cooking status detecting sensor 6, and calculation of the defrosting status detecting data are stored.

Accordingly, after receiving the switching signal from the door detect switching section which detects the closing status of the cooking chamber door, and then after detecting a key input for defrosting operation execution, the microcomputer 12 drives the magnetron 18 with the power corresponding to the food to defrost, while performing a controlling operation to rotate the turntable 24 loaded with the food to defrost at a predetermined speed so as to permit even radiation of microwaves onto the food to defrost.

Here, the microcomputer 12 sets a predetermined number of rotations of the turntable 24 as 1 turntable rotation period, and receives the data detected from the cooking status detecting sensor 6 while the turntable 24 is rotated one turntable rotation period. Here, the microcomputer 12 calculates the difference between the data of a certain turntable rotation period and a following turntable rotation period, and adjusts the magnetron output power in accordance with the data difference.

Meanwhile, the microcomputer 12 includes a preset data memory 12A storing a control program for adjusting the magnetron power for the defrosting function, and for calculating the defrosting status detect data obtained from the cooking status detecting sensor 6.

The magnetron driving circuit 16 controlled by the microcomputer 12 receives the high voltage formed by the high voltage power circuit 14 to drive the magnetron 18.

The motor driving section 20 controlled by the microcomputer 12 rotatably drives the turntable motor 22 to rotate the turntable 24 at a predetermined speed.

Figure 2:
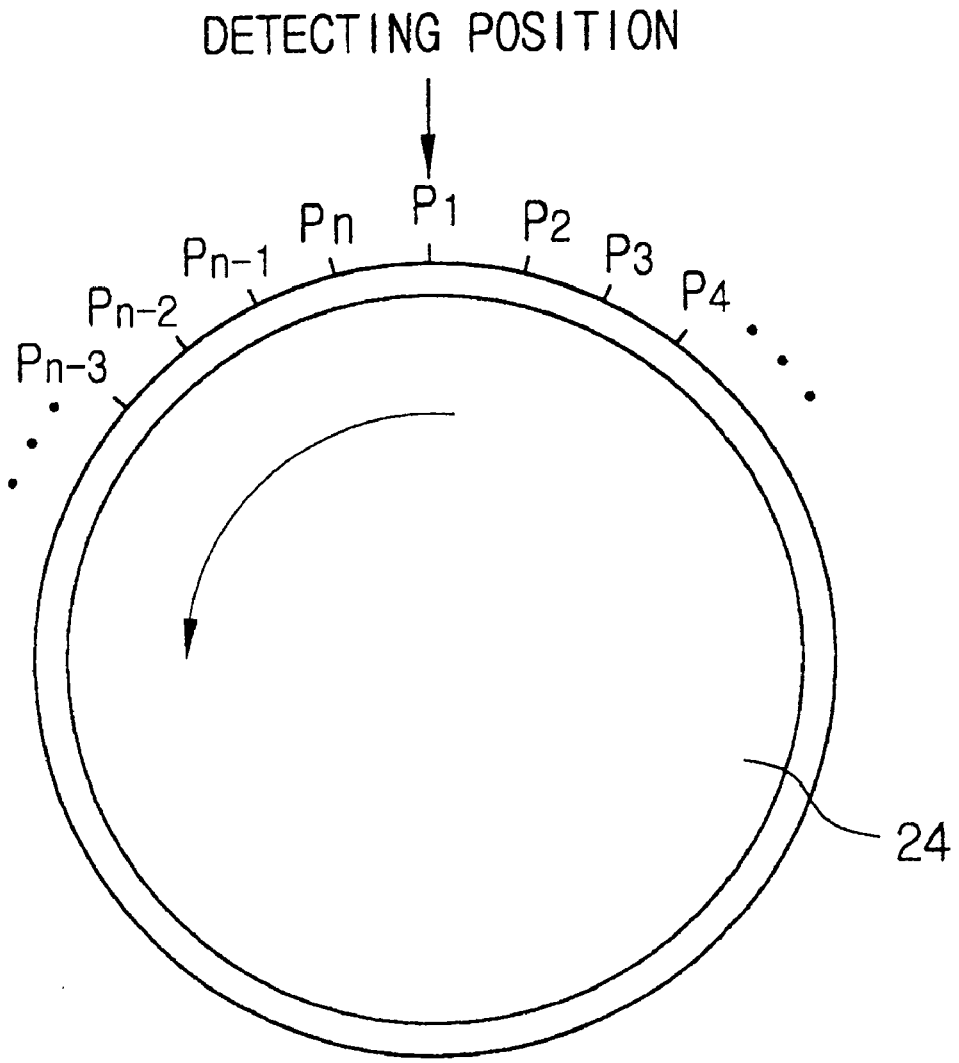
FIG. 2 is a view for showing detecting positions for detecting defrosting status of a food to defrost during a certain rotation period of a turn table, according to a first preferred embodiment of the present invention.

FIG. 2 is a view for showing detecting positions for detecting defrosting status of a food to defrost during a certain rotation period of a turn table, according to a first preferred embodiment of the present invention.

As shown in FIG. 2, during the rotation of the turntable 24, the microcomputer 12 collects the voltage signals which are outputted from the cooking status detecting sensor 6 from a plurality of detecting positions ($P_1$, $P_2$, $P_3$, $P_4$, . . . , $P_{n-3}$, $P_{n-2}$, $P_{n-1}$, $P_n$) on the regular basis.

Here, the microcomputer 12 sets three rotations of the turntable 24 (T1, T2, T3; See FIG. 3) as 1 turntable rotation period, and powers on/off the magnetron 18 during every turntable rotation period, i.e., during every three rotations of the turntable 24. Further, the microcomputer 12 regularly collects the data of voltage signals outputted from the cooking status detecting sensor 6 while the magnetron 18 is powered on. One rotation of the turntable 24 takes 10 seconds, and accordingly, the speed of the turntable 24 is 6 rpm.

Figure 3:
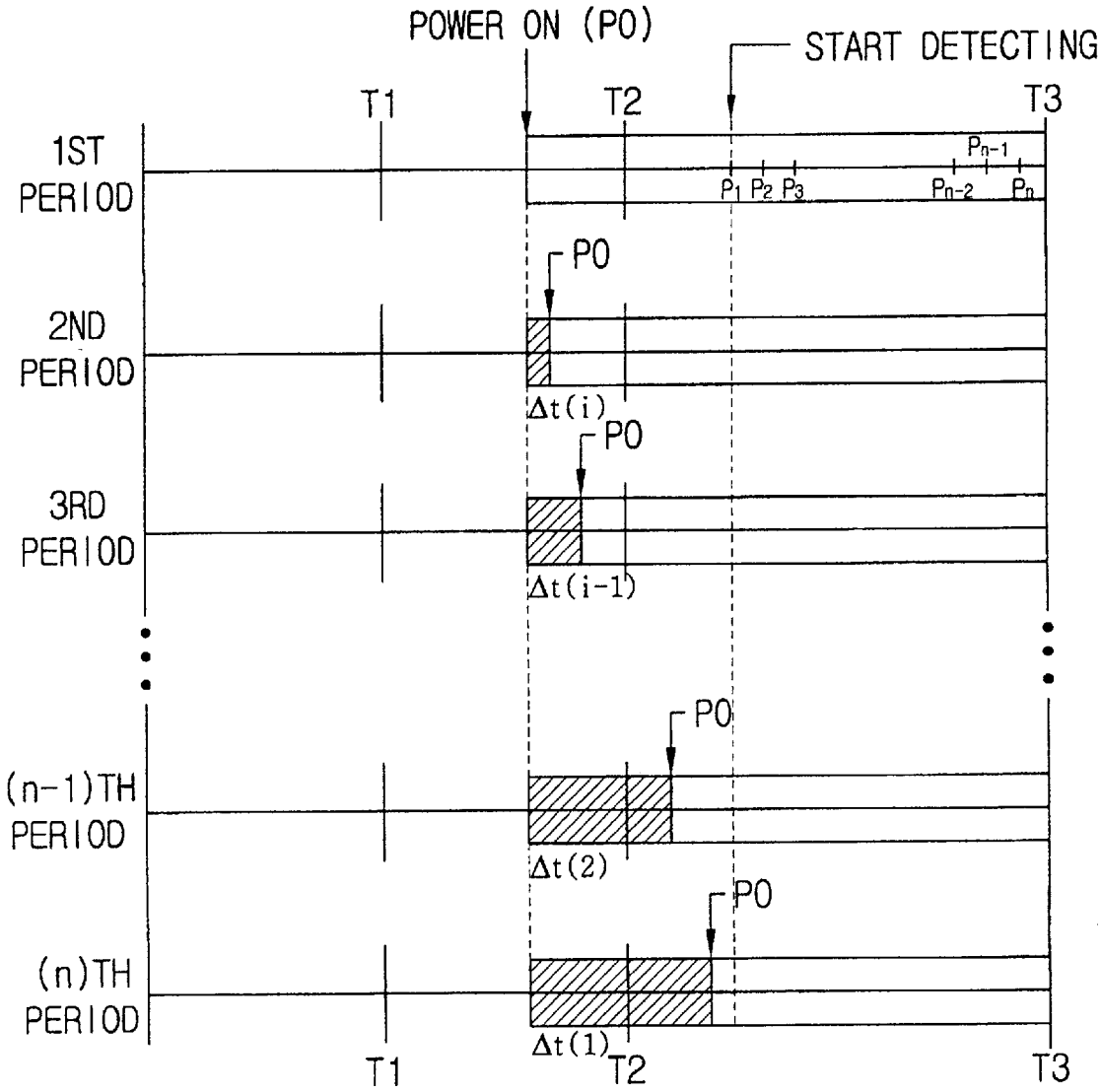
FIG. 3 is a view for showing one example in which a magnetron output power is variably adjusted for defrosting operation for a predetermined time period, according to the first preferred embodiment of the present invention.

FIG. 3 is a view for showing one example in which a magnetron output power is variably adjusted for defrosting operation for a predetermined time period, according to the first preferred embodiment of the present invention.

As shown in FIG. 3, the microcomputer 12 controls to generate the microwaves from the magnetron 18 during a power-on period which is determined by a certain power of the magnetron 18 during 1 turntable rotation period comprised of three rotations of the turntable 24 (T1, T2, T3). While the magnetron 18 is powered on, the microcomputer 12 collects the data of voltage signals outputted from the cooking status detecting sensor 6 from a certain detecting position of the turntable 24.

More specifically, the microcomputer 12 regularly collects the data from the cooking status detecting sensor 6 from a plurality of detecting positions ($P_1$, $P_2$, $P_3$, $P_4$, . . . , $P_{n-3}$, $P_{n-2}$, $P_{n-1}$, $P_n$) of the turntable 24.

The microcomputer 12 regularly and repetitiously collects the data detected from the it cooking status detecting sensor 6 during every magnetron power-on period of a plurality of the turntable rotation periods. Further, the microcomputer 12 calculates the difference between the data obtained from a certain turntable rotation period and the following turntable rotation period, and variably adjusts the magnetron power-on period for the next turntable rotation period in accordance with the calculated difference.

As shown in FIG. 3, from the first turntable rotation period through the later turntable rotation periods, the magnetron power-on period is gradually shortened by a compensating value which is obtained from the difference between the data detected from the respective turntable rotation periods and the respectively following turntable rotation periods. Accordingly, the magnetron power-on time PO is delayed as the magnetron power-on period is shortened. Also, as the power-on time PO is delayed, the power-off adjust time ($\Delta t(1)-\Delta t(n)$) is gradually increased corresponding to the compensating value.

Meanwhile, the magnetron power-on period ($t_{on}(n+1)$) and the magnetron power-off period ($t_{off}(n+1)$) are obtained by the following formulas 1 and 2:

[Formula 1]

$$t_{on}(n+1)=t_{on}(n)+\Delta t(n)$$

[Formula 2]

$$t_{off}(n+1)=t_{off}(n)-\Delta t(n)$$

According to the relation between the formulas 1 and 2, as the magnetron power-on period $t_{on}(n+1)$ is decreased, the magnetron power-off period $t_{off}(n+1)$ is accordingly increased, while, as the magnetron power-on period $t_{on}(n+1)$ is increased, the magnetron power-off period $t_{off}(n+1)$ is decreased.

Figure 4:
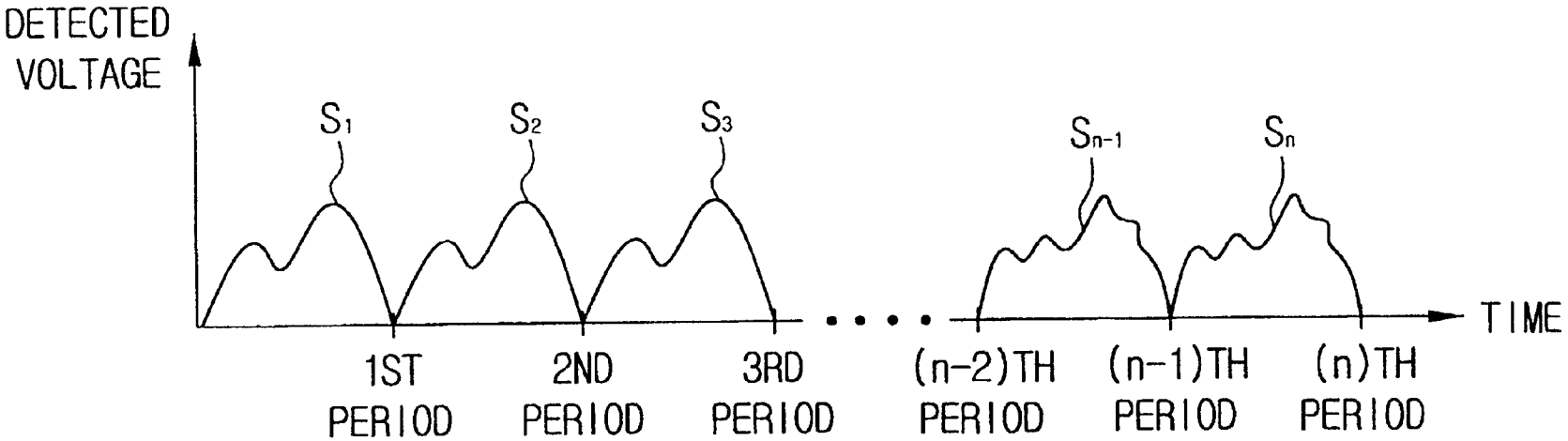
FIG. 4 is a waveform for showing changing frozen status of the food to defrost collected from a sensor for a predetermined time period.

FIG. 4 is a waveform for showing changing frozen status of the food to defrost collected from a sensor for a predetermined time period. According to FIG. 4, the voltage values obtained from the cooking status detecting sensor 6 from the first turntable rotation period to is the (n)th turntable rotation period are varied according to the defrosting time progress.

Here, $S_1$, $S_2$, $S_3$, , , , , $S_{n-1}$, $S_n$ are the summation of the detected voltage values which are collected from the cooking status detecting sensor 6 during every power-on period of the respective turntable rotation periods. And hereinafter, the summation of the detected voltage values of the respective turntable rotation periods will be called a 'detected data'.

According to the first preferred embodiment of the present invention, considering the fact that the voltage values obtained from the cooking status detecting sensor 6 during a plurality of turntable rotation periods are varied according to the defrosting time progress, a compensating value is differently applied to adjust the magnetron power-on period $t_{on}(n+1)$.

Figure 5A:
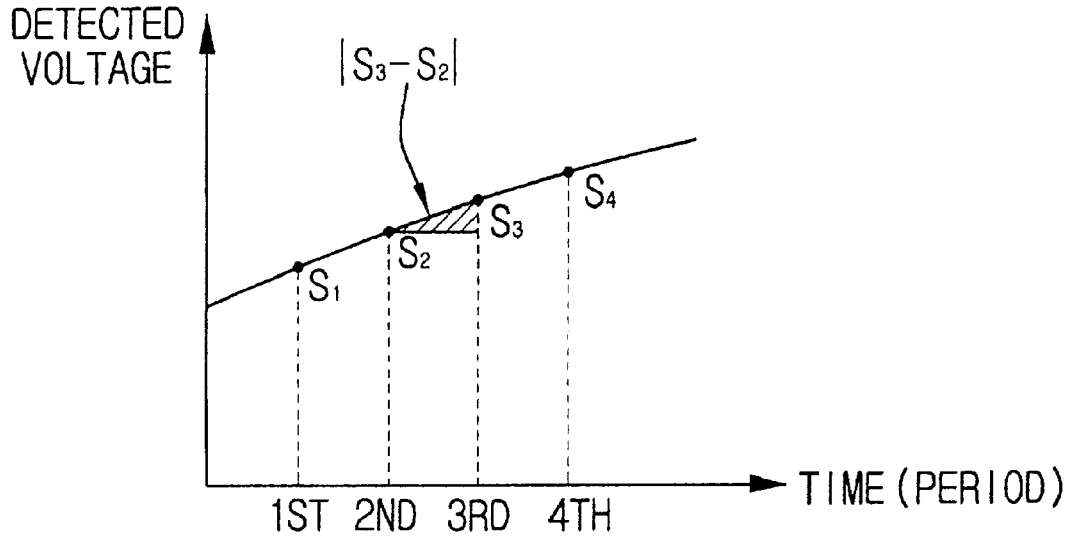
FIGS. 5A and 5B are waveforms for showing one example in which the magnetron output power is adjusted based on differences between data detected from the sensor, according to the first preferred embodiment of the present invention.
Figure 5B:
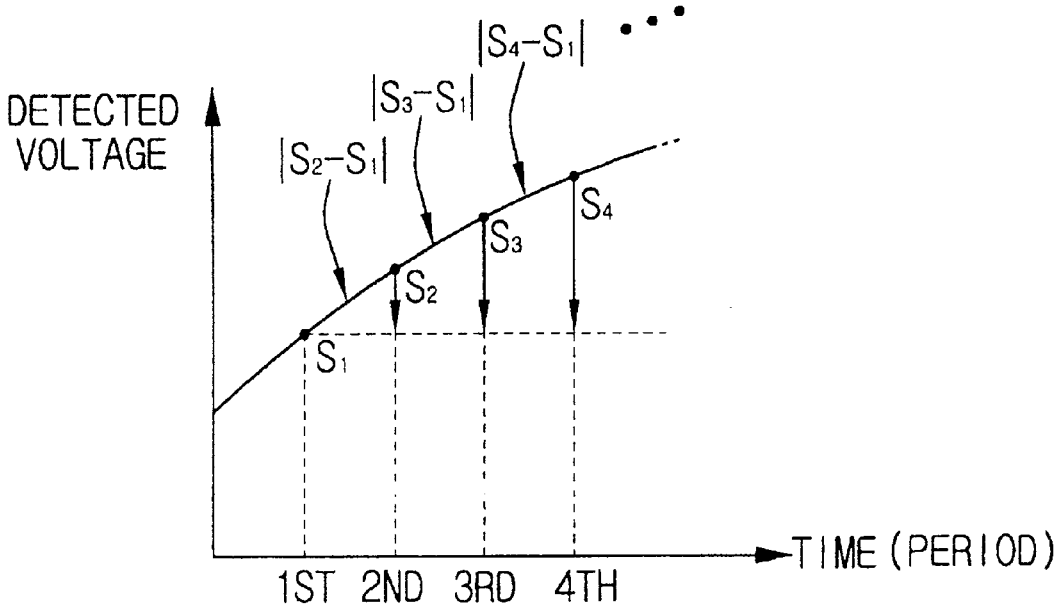

FIGS. 5A and 5B are waveforms for showing one example in which the magnetron output power is adjusted based on differences between data detected from the sensor, according to the first preferred embodiment of the present invention.

As shown in FIG. 5A, according to the first preferred embodiment of the present invention, the microcomputer 12 calculates the differences between the respective detected data ($S_1$, $S_2$, $S_3$, , , , , $S_n$) detected by the cooking status detecting sensor 6 during the respective turntable rotation periods. The difference calculations of the detected data ($S_1$, $S_2$, $S_3$, , , , , $S_n$) of the respective turntable rotation periods are used as the compensating values for adjusting the next magnetron power-on period $t_{on}(n+1)$.

According to FIG. 5A for example, the microcomputer 12 calculates the difference between the detected data ($S_3$) from the third turntable rotation period and the detected data ($S_2$) from the second turntable rotation period, and adjusts the magnetron power output in accordance with the calculation. The adjusted magnetron output power is used for adjusting the magnetron power-on period $t_{on}(n+1)$ in the fourth turntable rotation period.

The difference ($d_n$) calculation between the respective data are obtained by the following absolute modulus:

[Formula 3]

$$d_n=|S_n-S_{n-1}|$$

As shown in FIG. 5B, according to the first preferred embodiment of the present invention, the microcomputer 12 calculates the difference between the detected data ($S_1$) and ($S_2$~$S_n$) detected by the cooking status detecting sensor 6 during the first turntable rotation period and the second to the (n)th turntable rotation periods, respectively. The respective differences calculated between the detected data ($S_1$) and the respective detected data ($S_2$~$S_n$) from the first turntable rotation period and the second to the (n)th turntable rotation periods are used as the compensating values for adjusting the magnetron power-on period $t_{on}(n+1)$ for the next respective turntable rotation periods.

Here, the differences ($d_1$, $d_2$, $d_3$, . . . , $d_n$) between the respective data are obtained by the following absolute values:

[Formula 4]

$$d_1 = |S_2 - S_1|$$
$$d_2 = |S_3 - S_1|$$
$$d_3 = |S_4 - S_1|$$
$$\cdots$$
$$d_n = |S_n - S_1|$$

Figure 6:
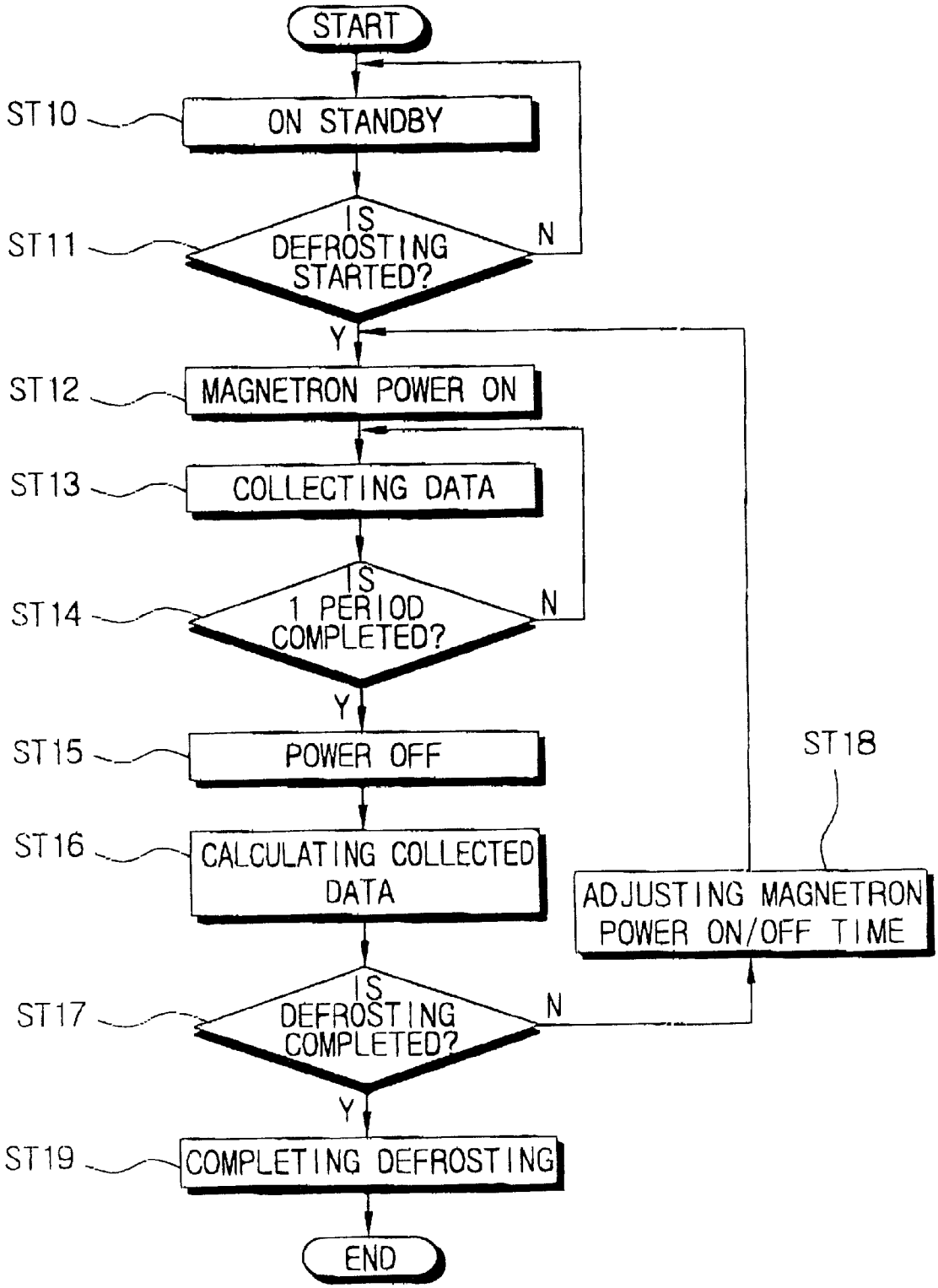
FIG. 6 is a flow chart for explaining the defrosting method for the microwave oven according to the present invention.

Next, the operation of the microwave oven according to the first preferred embodiment of the present invention will be described with reference to the flow chart of FIG. 6 below:

First, the food to defrost is placed in the cooking chamber of the microwave oven, and the cooking chamber door is closed. Then, the door detect switching section 4 generates the switching signal upon detecting the closing status of the door. The microcomputer 12 receives the door detect switching signal from the door detect switching section 4, and sets the microwave oven on standby for defrosting operation (step ST10).

Then the microcomputer 12 determines whether there is a key input for defrosting operation execution from the key input section 2 (step ST11).

Upon determining the presence of key input for executing the defrosting operation, the microcomputer 12 drives the magnetron driving circuit 16 so that the magnetron 18 generates the microwaves of a predetermined degree for the defrosting operation. Also, the microcomputer 12 drives the motor driving section 20 so that the turntable motor 22 is rotatably driven to rotate the turntable 24 at a certain speed (step ST12).

Here, as shown in FIG. 3, the microcomputer determines the magnetron power-on period while setting three rotations of the turntable 24 as 1 turntable rotation period.

In such a situation, the microcomputer 12 regularly receives the voltage signals about the cooking status of the food detected by the cooking status detecting sensor 6 from a certain detecting position through the voltage detecting section 8, and thus collects the data (step ST13).

Meanwhile, the microcomputer 12 determines whether the 1 turntable rotation period corresponding to three rotations of the turntable 24 is completed or not (step ST14).

When the microcomputer 12 determines the completion of 1 turntable rotation period, the microcomputer 12 powers-off the magnetron 18 (step ST15).

Next, the microcomputer 12 calculates the data collected from the cooking status detecting sensor 6 during the magnetron power-on period (step ST16).

That is, as shown in FIG. 5A, the microcomputer 12 calculates the absolute difference ($|S_n-S_{n-1}|$) between the detected data collected from a certain turntable rotation period and the one-period previous turntable rotation period, such as the absolute difference ($|S_3-S_2|$) of the detected data ($S_3$) collected from the third turntable rotation period and the detected data ($S_2$) collected from the second turntable rotation period.

Further, as shown in FIG. 5B, the microcomputer 12 may calculate the absolute differences between the detected data ($S_1$) detected from the first turntable rotation period and the detected data ($S_2$~$S_n$) detected from the second turntable rotation period to the (n)th turntable rotation period, respectively.

The differences between the detected data of the certain turntable rotation periods are used as the compensating values for adjusting the magnetron output power for the next turntable rotation period.

After that, the microcomputer 12 determines whether it is defrosting completion time or not based on the calculation of the collected data (step ST17).

When determining that it is not the defrosting completion time yet, the microcomputer 12 adjusts the magnetron power-on period by applying the compensating value of calculation of the collected data (step ST18), and repeats the steps from ST12 to ST17.

Accordingly, as shown in FIG. 3, the magnetron power-on period is variably adjusted during the respective turntable rotation periods to be gradually decreased, while the magnetron power-off period is gradually increased.

Meanwhile, when determining that it is defrosting completion time, the microcomputer 12 completes the defrosting function by the magnetron 12 (step ST19).

Next, the method according to the second preferred embodiment of the present invention will be described in greater detail with reference to the accompanying drawings.

First, since the construction of the microwave oven employing the defrosting method according to the second preferred embodiment is identical with the construction of the microwave oven according to the first preferred embodiment, the additional description thereof will be omitted.

The unique features of the second preferred embodiment of the present invention lie in the control program having the preset data memory 12A and its processing method, and the data stored in the status data memory 10.

More specifically, the microcomputer 12 determines the SLOPE of the curves of the differences between the data detected during the respective turntable rotation periods. Then, by comparing the slopes with preset data about the magnetron output power adjust range, the microcomputer 12 selects the most appropriate value for the slopes of the curves between the respective turntable rotation periods. And the magnetron output power is adjusted according to the most appropriate value.

Meanwhile, in the preset data memory 12A, a control program having a control algorithm is stored to adjust the magnetron output power in accordance with the changing slopes of the data detected during the respective turntable rotation periods. Further, in the preset data memory 12A, preset data about a plurality of the magnetron output power adjust ranges are stored in the tabled form.

Figure 7:
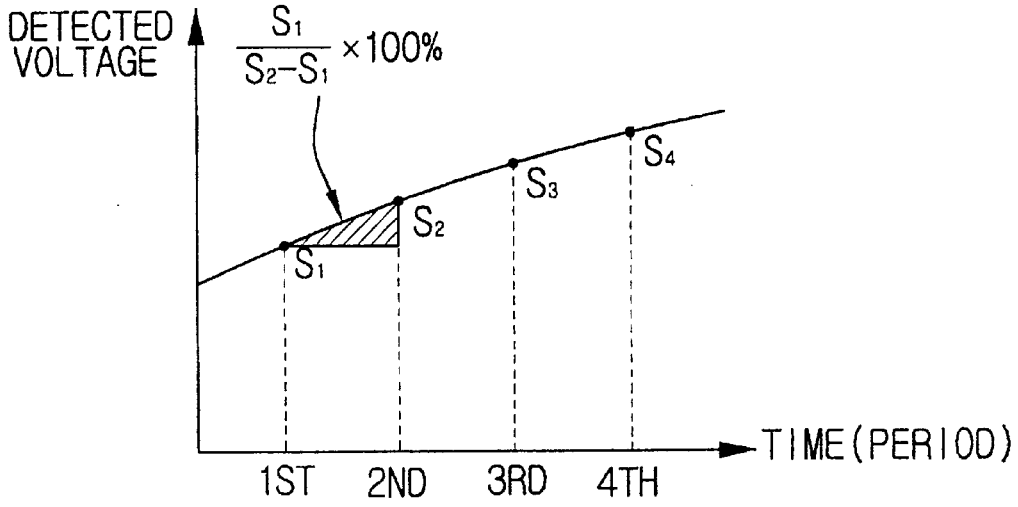
FIG. 7 is a waveform for showing one example in which the slopes of the data detected from the sensor changing according to the time progress are processed to percentage, for ash adjusting the magnetron output power.

FIG. 7 is a waveform for showing one example in which the slopes of the data detected from the sensor changing according to the time progress are processed to percentage, for adjusting the magnetron output power.

As shown in FIG. 7, according to the second preferred embodiment of the present invention, the slopes of the curves of the data detected by the cooking status detecting sensor 6 during the respective turntable rotation periods is calculated. The slope is compared with a plurality of preset data of the percent magnetron output power adjust ranges, respectively. Accordingly, the preset data of the magnetron output power adjust range including the slope therein, is selected to be used as the actual magnetron output power adjust range.

Meanwhile, the magnetron output power adjust range having the slope ($S_n$–$S_{n-1}$) of the data detected during the respective turntable rotation periods is obtained by the following formula 5:

[Formula 5]

$$S_L < S_n - S_{n-1} < S_H$$

where, $S_L$ and $S_H$ are the lowest and highest values of the magnetron output power adjust range, respectively.

The lowest and highest values $S_L$ and $S_H$ of the magnetron output power adjust range are obtained by the following formula 6, respectively:

[Formula 6]

$$S_L = S_1 \times K_L$$

$$S_H = S_1 \times K_H \ (0 \leqq KL < K_H \leqq 1)$$

where, $K_L$ is the lowest coefficient of the magnetron output power adjust range, and $K_H$ is the highest coefficient of the magnetron output power adjust range. The lowest and highest coefficients ($K_L$ and $K_H$) are processed to percentage for adding and subtracting the magnetron as output power, and are stored in the preset data memory 12A having a plurality of adjust ranges in the tabled form.

As shown in FIG. 7, the slope of the data detected during the respective turntable rotation periods can be processed to percentage by the above formula 6, and the percent value is used as the adjust percentage for determining the degree of adding and subtracting of the magnetron power-on period of the following turntable rotation period.

Figure 8:
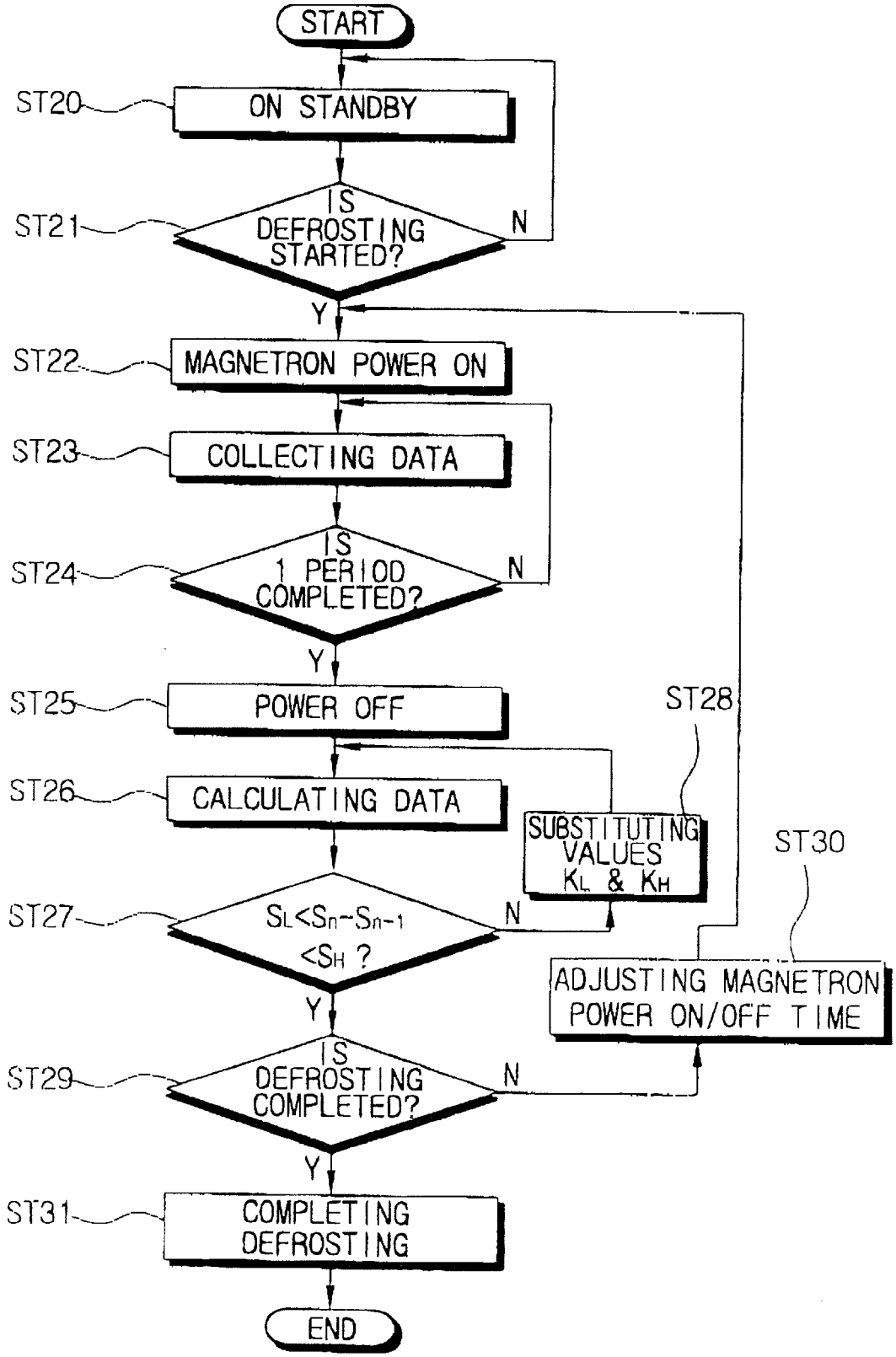
FIG. 8 is a flow chart for explaining a defrosting method for a microwave oven according to a second preferred embodiment of the present invention.

The operation of the microwave oven according to the second preferred embodiment of the present invention will be described in greater detail below with reference to the flow chart of FIG. 8.

First, the food to defrost is placed in the cooking chamber of the microwave oven, and the cooking chamber door is closed. Then, the door detect switching section 4 generates the switching signal upon detecting the closing status of the door. The microcomputer 12 receives the door detect switching signal from the door detect switching section 4, and sets the microwave oven on standby for defrosting operation (step ST20).

Then the microcomputer 12 determines whether there is a key input for defrosting operation execution from the key input section 2 (step ST21).

Upon determining the presence of key input for executing the defrosting operation, the microcomputer 12 drives the magnetron driving circuit 16 so that the magnetron 18 generates the microwaves of a predetermined degree for the defrosting operation. Also, the microcomputer 12 drives the motor driving section 20 so that the turntable motor 22 is rotatably driven to rotate the turntable 24 at a certain speed (step ST22).

In such a situation, the microcomputer 12 regularly receives the voltage signals about the cooking status of the food detected by the cooking status detecting sensor 6 from a certain detecting position through the voltage detecting section 8, and thus collects the data (step ST23).

Meanwhile, the microcomputer 12 determines whether the 1 turntable rotation period corresponding to three rotations of the turntable 24 is completed or not (step ST24).

When the microcomputer 12 determines the 1 turntable rotation period is completed, the microcomputer 12 powers-off the magnetron 18 (step ST25).

Next, the microcomputer 12 calculates the data collected from the cooking status detecting sensor 6 during the magnetron power-on period (step ST26).

That is, the microcomputer 12 calculates the slope of data detected during the respective turntable rotation periods, and selects the magnetron output power adjust range having the slope therein among a plurality of magnetron output power adjust ranges stored in the preset data memory 12A.

Meanwhile, the plurality of magnetron output power adjust ranges have minimum and maximum values $S_L$ and $S_H$ determined by the lowest and highest coefficients ($K_L$ and $K_H$).

Then, the microcomputer 12 determines whether or not the slope falls into the range between the minimum and maximum values $S_L$ and $S_H$ determined by the lowest and highest coefficients ($K_L$ and $K_H$) of the magnetron output power adjust ranges (step ST27).

When determining that the slope does not fall into the range between the minimum and maximum values $S_L$ and $S_H$ of the magnetron output power adjust range, the microcomputer 12 substitutes the lowest and highest coefficients ($K_L$ and $K_H$) with another lowest and highest coefficients ($K_L$ and $K_H$) (step ST28), and obtains the minimum and maximum values $S_L$ and $S_H$ by another lowest and highest coefficients($K_L$ and $K_H$) on the step ST26, and proceeds to the step ST27.

Meanwhile, when determining that the slope falls into the range between the minimum and maximum values $S_L$ and $S_H$ of the magnetron output power adjust range, the microcomputer 12 determines whether the preset data for the magnetron output power adjust range has the data for completing the defrosting operation or not (step ST29).

When determining that the preset data of the magnetron output power adjust range having the slope therein does not have data for completing defrosting operation, the microcomputer 12 adjusts the magnetron power-on period in accordance with the adjust percentage obtained from the lowest and highest coefficients ($K_L$ and $K_H$) of the magnetron output power adjust range (step ST30), and proceeds to the step ST22.

When determining that the preset data of the magnetron output power adjust range having the slope therein has the data for completing defrosting operation, the microcomputer 12 completes the defrosting operation (step ST31).

Next, the method according to the third preferred embodiment of the present invention will be described in greater detail below:

The unique features of the third preferred embodiment of the present invention with the second preferred embodiment lie in the control program and control program processing method of the microcomputer 12 having the preset data memory 12A shown in FIG. 1, and the data stored in the status data memory 10.

That is, after the turntable 24 is rotated for a certain time period for a plurality of turntable rotation periods, the microcomputer 12 detects the change of slope of the data detected during the respective turntable rotation periods. Then the microcomputer 12 obtains the defrosting completion time by determining whether the food in the microwave oven is light-loaded, weight-loaded, or no-loaded, in accordance with the change degree of the slope of the data detected for the certain time period.

Here, in the preset data memory 12A, a control program having a control algorithm is stored for determining defrosting completion time by calculating the slope of the detected data.

Figure 9A:
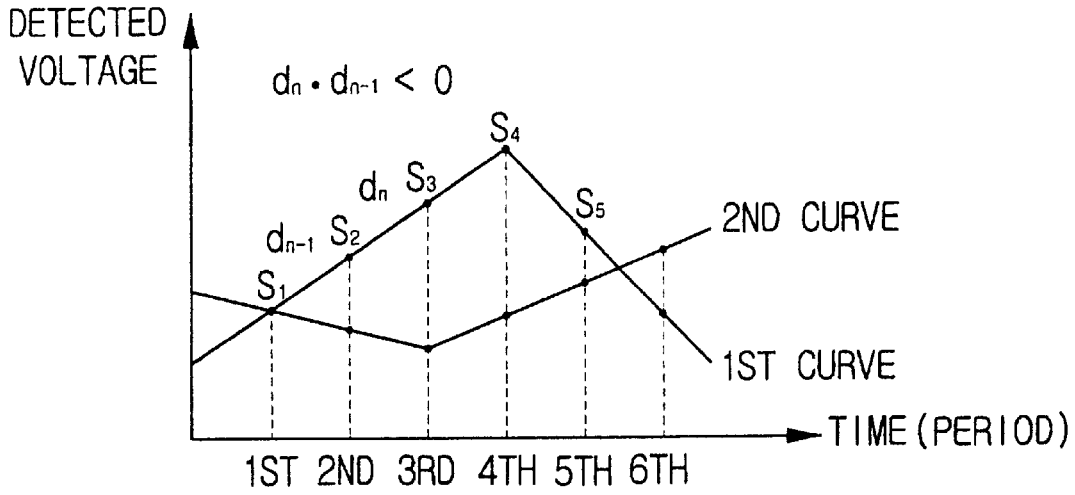
FIGS. 9A to 9C are waveforms for showing one example in which the magnetron output power is adjusted in accordance with the slopes of the data detected from the sensor which are changing in accordance with the time progress, according to a third preferred embodiment of the present invention.
Figure 9B:
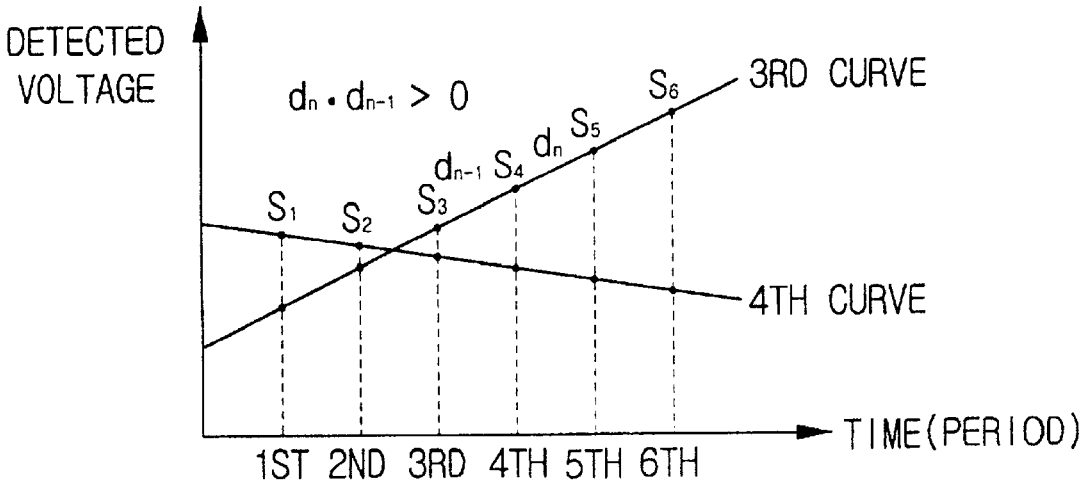
Figure 9C:
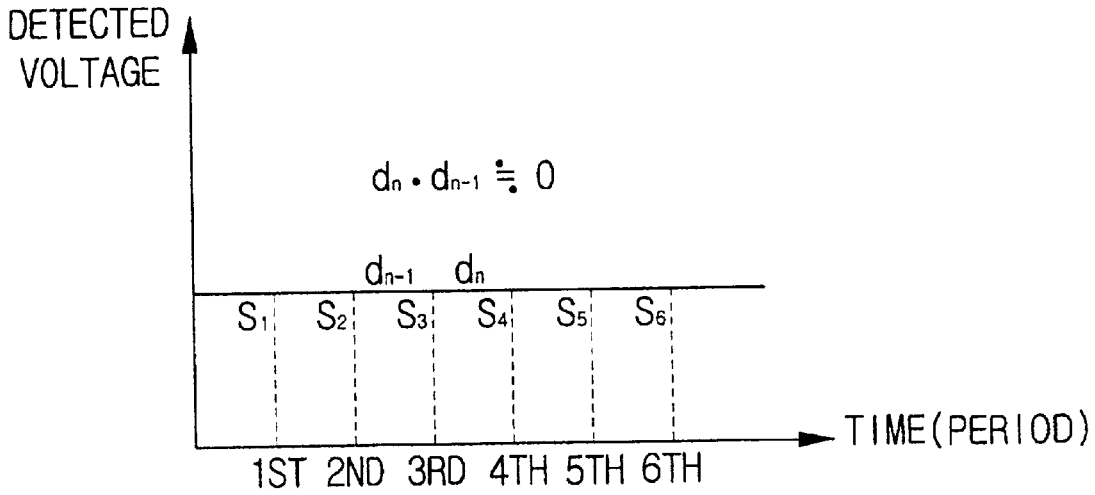

FIGS. 9A to 9C are waveforms for showing one example in which the magnetron output power is adjusted in accordance with the slopes of the data detected from the sensor which are changing in accordance with the time progress, according to a third preferred embodiment of the present invention.

As shown in FIGS. 9A to 9C, after obtaining both of the slope ($d_{n-1}$) of the difference between the detected data outputted from the certain turntable rotation period and the next turntable rotation period such as the difference between the detected data ($S_2$ and $S_3$) outputted from the second and third rotation periods, and the slope ($d_n$) of the difference between the detected data outputted from the next turntable rotation period and from the turntable rotation period following the next turntable rotation such as the difference between the detected data ($S_3$ and $S_4$) outputted from the third and fourth rotation periods, the load status of the food is determined by multiplying the slopes ($d_n$ and $d_{n-1}$)as follows:

[Formula 7]

$$d_n X\ d_{n-1}<0 \text{ (light-loaded)}$$

$$d_n X\ d_{n-1}>0 \text{ (weight-loaded)}$$

$$d_n X\ d_{n-1}\approx 0 \text{ (no-loaded)}$$

First, as shown in FIG. 9A, in the first curve, the multiplication of the slope ($d_2$) between the detected data ($S_2$ and $S_3$) of the second and third turntable rotation periods and the slope ($d_3$) between the detected data ($S_3$ and $S_4$) of the third and fourth turntable rotation periods is less than "0". Meanwhile, in the second curve, the multiplication of the slope ($d_3$) between the detected data ($S_3$ and $S_4$) of the third and fourth turntable rotation periods, and the slope ($d_4$) between the detected data ($S_4$ and $S_5$) of the fourth and fifth turntable rotation periods is less than "0".

As described, when the slope ($d_{n-1}$) of the detected data of the certain turntable rotation periods is positive (negative) and when another slope ($d_n$) obtained next to the slope ($d_{n-1}$) is negative (positive), the multiplication of the slopes ($d_n$X $d_{n-1}$) is less than "0", and the food is determined to be light-loaded.

Further, as shown in FIG. 9B, in the third or fourth curve where the slopes ($d_n$ and $d_{n-1}$) of the detected data outputted from the respective turntable rotation periods are always positive or negative, the multiplication of the respective slopes ($d_n$ and $d_{n-1}$) is greater than "0", and the food is determined to be weight-loaded.

As shown in FIG. 9C, the respective detected data of the respective turntable rotation periods and the respectively following turntable rotation periods are almost the same, and accordingly the multiplication of the respective slopes ($d_n$ and $d_{n-1}$) reaches "0", and the food is determined to be no-loaded.

Figure 10:
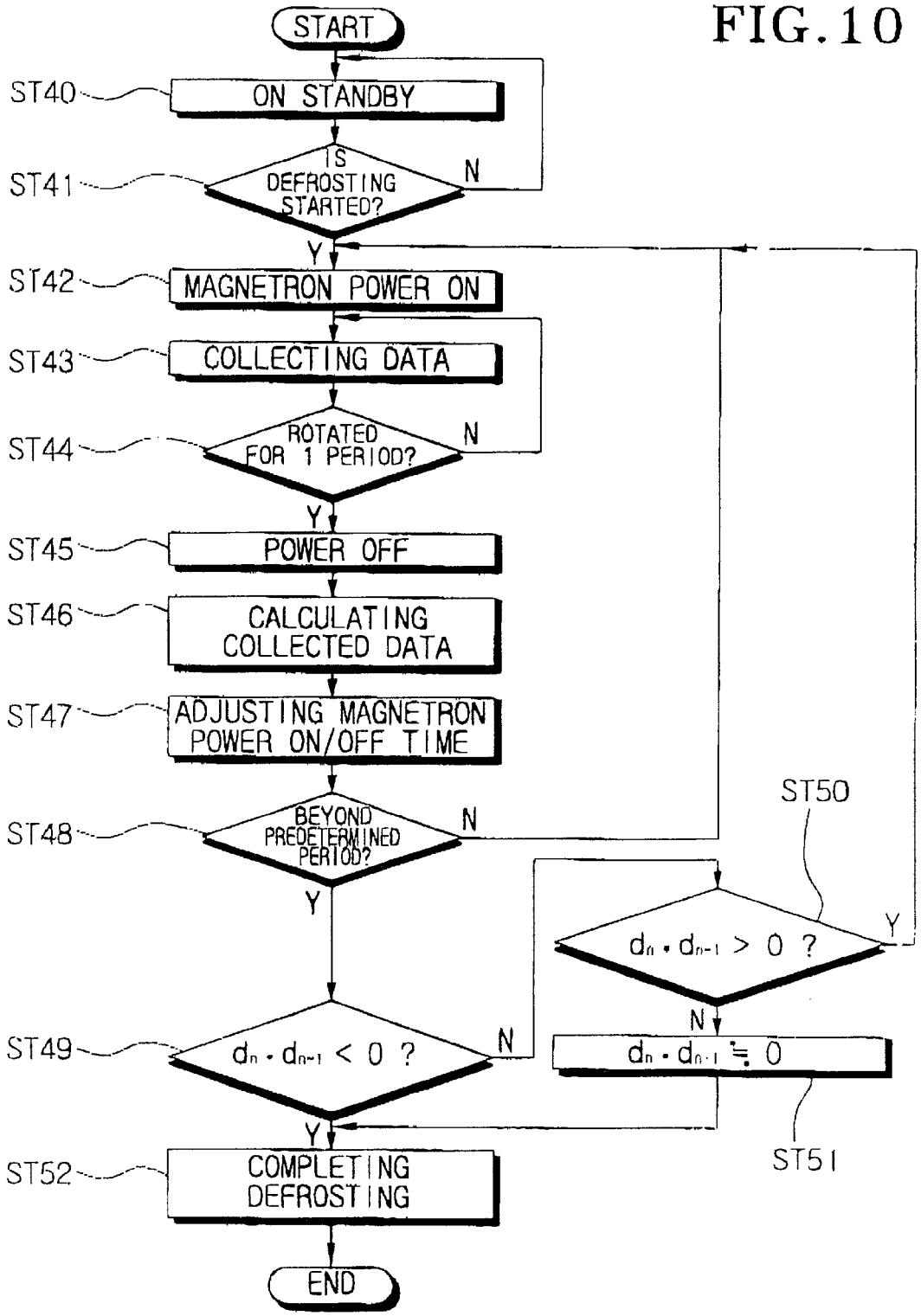
FIG. 10 is a flow chart for explaining a defrosting method for a microwave oven according to the third preferred embodiment of the present invention.

The method according to the third preferred embodiment of the present invention will be described in greater detail with reference to the flow chart of FIG. 10.

First, in a state that the microwave oven is on standby for defrosting operation (step ST40), the microcomputer 12 determines whether there is a key input for defrosting operation execution from the key input section 2 (step ST41).

Upon determining the presence of key input for executing the defrosting operation, the microcomputer 12 controls the magnetron 18 to generate the microwaves of a predetermined degree for the defrosting operation. Also, the microcomputer 12 rotate the turntable 24 at a certain speed (step ST42).

In such a situation, the microcomputer 12 regularly receives the voltage signals about the cooking status of the food detected by the cooking status detecting sensor 6 from a certain detecting position through the voltage detecting section 8, and thus collects the data (step ST43).

Meanwhile, the microcomputer 12 determines whether the 1 turntable rotation period corresponding to three rotations of the turntable 24 is completed or not (step ST44).

When the microcomputer 12 determines the 1 turntable rotation period is completed, the microcomputer 12 powers-off the magnetron 18 (step ST45).

Next, the microcomputer 12 calculates the data collected from the cooking status detecting sensor 6 during the magnetron power-on period (step ST46), and adjusts the magnetron power-on/off periods according to the calculation (step ST47).

In such a situation, the microcomputer 12 determines whether the turntable 24 is rotated for the preset time period, such as for 2 turntable rotation periods (step ST48).

When determining that the preset time period is elapsed, the microcomputer 12 obtains the slope($d_{n-1}$) by calculating the difference between the data detected during certain turntable rotation period and the next turntable rotation period, and also obtains another sloping degree ($d_n$) by calculating the difference between the data detected during the next turntable rotation period and one-period next turntable rotation period, respectively. Then, the microcomputer 12 multiplies the respective slopes ($d_n$X $d_{n-1}$), to determine the load of the weight (step ST49).

By the multiplication of the respective slopes ($d_n$X $d_{n-1}$), the microcomputer determines whether the food is light-loaded, weight-loaded, or no-loaded (step ST50).

When determining the food as the weight-loaded by the multiplication of the respective slopes ($d_n$X $d_{n-1}$) (step ST51), the microcomputer 12 proceeds to the step ST42, and drives the magnetron 18 in accordance with the magnetron power on/off periods adjusted in the step ST47.

When determining the food as the no-loaded as a result of multiplying the respective slopes ($d_n$X $d_{n-1}$) (step ST52), the microcomputer 12 stops driving the magnetron 18, and immediately completes the defrosting operation (step ST53).

Further, when determining the food as the light-loaded as a result of determination in step ST50, the microcomputer 12 also completes the defrosting operation (step ST53).

The microwave oven according to the fourth preferred embodiment of the present invention will be described in greater detail with reference to the accompanying drawings.

Here, the unique features of the fourth preferred embodiment distinguished from the third preferred embodiment of the present invention lie in the control program and control processing method of the microcomputer 12 having the preset data memory 12A, and the data stored in the status data memory 10.

That is, the microcomputer 12 converts the detected data, i.e., the summation of the detected voltage from the respective turntable rotation periods into a cubic equation. Then the microcomputer 12 converts the cubic equation into a quadratic equation by differentiation, and adjusts the power of magnetron or obtains the defrosting completion time with local maximum and local minimum of the detected data which the microcomputer 12 obtained from the quadratic equation.

In the preset data memory 12A, a control program having a control algorithm is stored for calculating the cubic equation with respect to the detected data from the respective turntable rotation periods, magnetron power adjustment through the differentiation of the cubic equation, and the defrosting completion time.

Figure 11A:
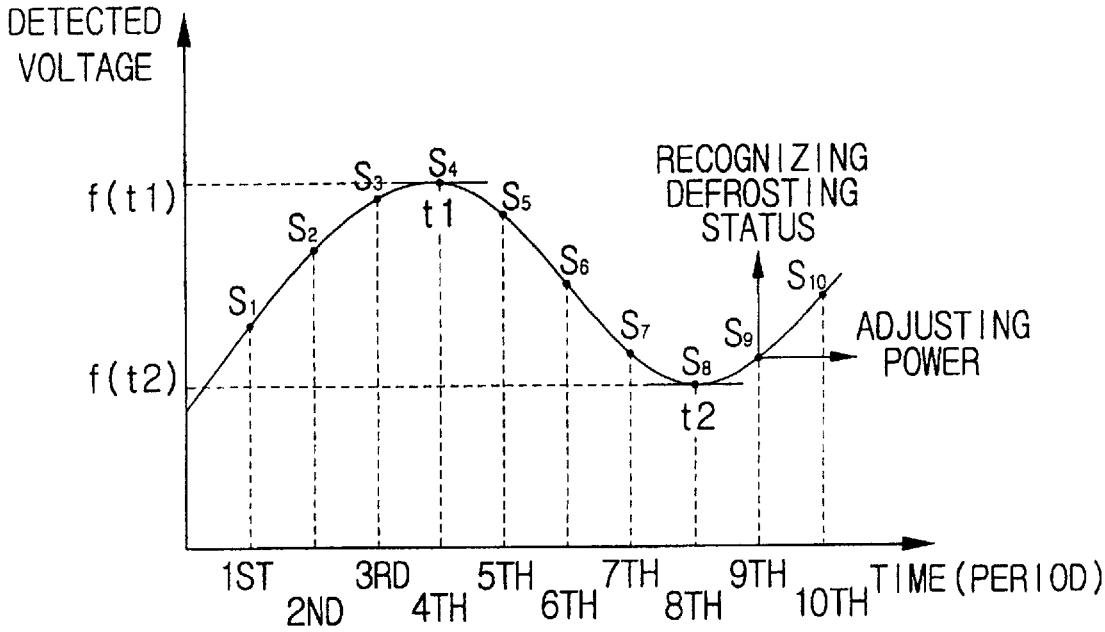
FIGS. 11A and 11B are waveforms for showing one example in which the magnetron output power is adjusted by comparing maximum and minimum of the data sensed from the sensor according to a fourth preferred embodiment of the present invention.
Figure 11B:
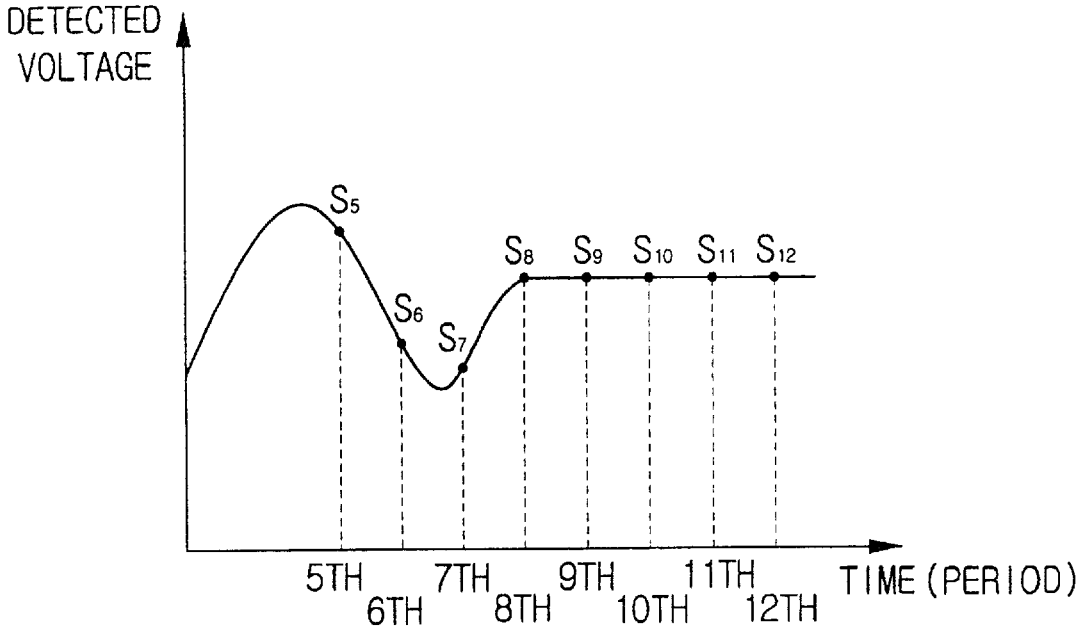

FIGS. 11A and 11B are waveforms for showing one example in which the magnetron output power is adjusted by comparing maximum and minimum of the data sensed from the sensor according to a fourth preferred embodiment of the present invention.

As shown in FIG. 11A, the microcomputer 12 obtains the cubic equation from the detected data ($S_n$~$S_n$) collected from a plurality of the turntable rotation periods. Such is shown in the following formula 8:

[Formula 8]

$$f(t)=at^3+bt^2+ct+d$$

The cubic equation of the above formula 8 is converted into the quadratic equation having points (t1 and t2) for the local maximum and minimum through the differentiation. Such is shown in the following formula 9:

[Formula 9]

$$f'(t) = a't^2 + b't + c'$$

(where, $$t1 = \frac{-b' + \sqrt{b'^2 - 4a'c'}}{2a'},$$

$$t2 = \frac{-b' - \sqrt{b'^2 - 4a'c'}}{2a'}$$

Accordingly, the microcomputer 12 calculates the time variation by the difference a between the points (t1 and t2) for the local maximum and minimum of the detected data which are obtained through the differentiation of the cubic equation of the detected data, and also calculates the data variation by the difference between the value of function of the point (t1) (i.e., f(t1): local maximum) and the value of function of point (t2) (i.e., f(t2): local minimum). The microcomputer 12 utilizes the time and data variations for analyzing the type and weight of the defrosting food.

When the status of the defrosting food such as the type or weight is analyzed, the time and data variations may be utilized as the compensating values for adjusting the magnetron power, or may be utilized as the values for calculation for obtaining the defrosting completion time.

Meanwhile, whether to utilize the points (t1 and t2), i.e., roots obtained through the differentiation as the compensating values or not, is determined by the following formula 10 is a real or a multiple, or an imaginary root:

[Formula 10]

$$D=\sqrt{b'^2-4a'c'}$$

(Here, the points (t1 and t2) have two real roots when D>0, have multiple root when D=0, and have imaginary root when D<0.)

Accordingly, the microcomputer 12 can utilize the points (t1 and t2) as the compensating values when the points (t1 and t2) have two real roots, or the multiple root.

Further, as shown in FIG. 11B, when defrosting a certain food, the detected data are uniformly outputted from a plurality of turntable rotation periods at the defrosting completion time, so that there is almost no changes between the detected data.

Accordingly, considering such a defrosting characteristic of the food, the microcomputer 12 obtains the difference between the detected data outputted from a certain turntable rotation period and the next turntable rotation period, to add differences obtained from at least five (5) turntable rotation periods. Such is shown in the following formula 11:

[Formula 11]

$$d_n=|S_n-S_{n-1}|$$

$$d_{n-1\ 1}=|S_{n-1}-S_{n-2}|$$

$$d_{n-2}=|S_{n-2}-S_{n-3}|$$

$$d_{n-3}=|S_{n-3}-S_{n-4}|$$

$$X=d_n+d_{n-1}+d_{n-2}+d_{n-3}$$

Here, when the summation (X) of the differences between the detected data obtained from at least 5 turntable rotation periods falls below a certain value, the microcomputer 12 recognizes the defrosting completion, so that the microcomputer 12 completes the defrosting operation.

Figure 12A:
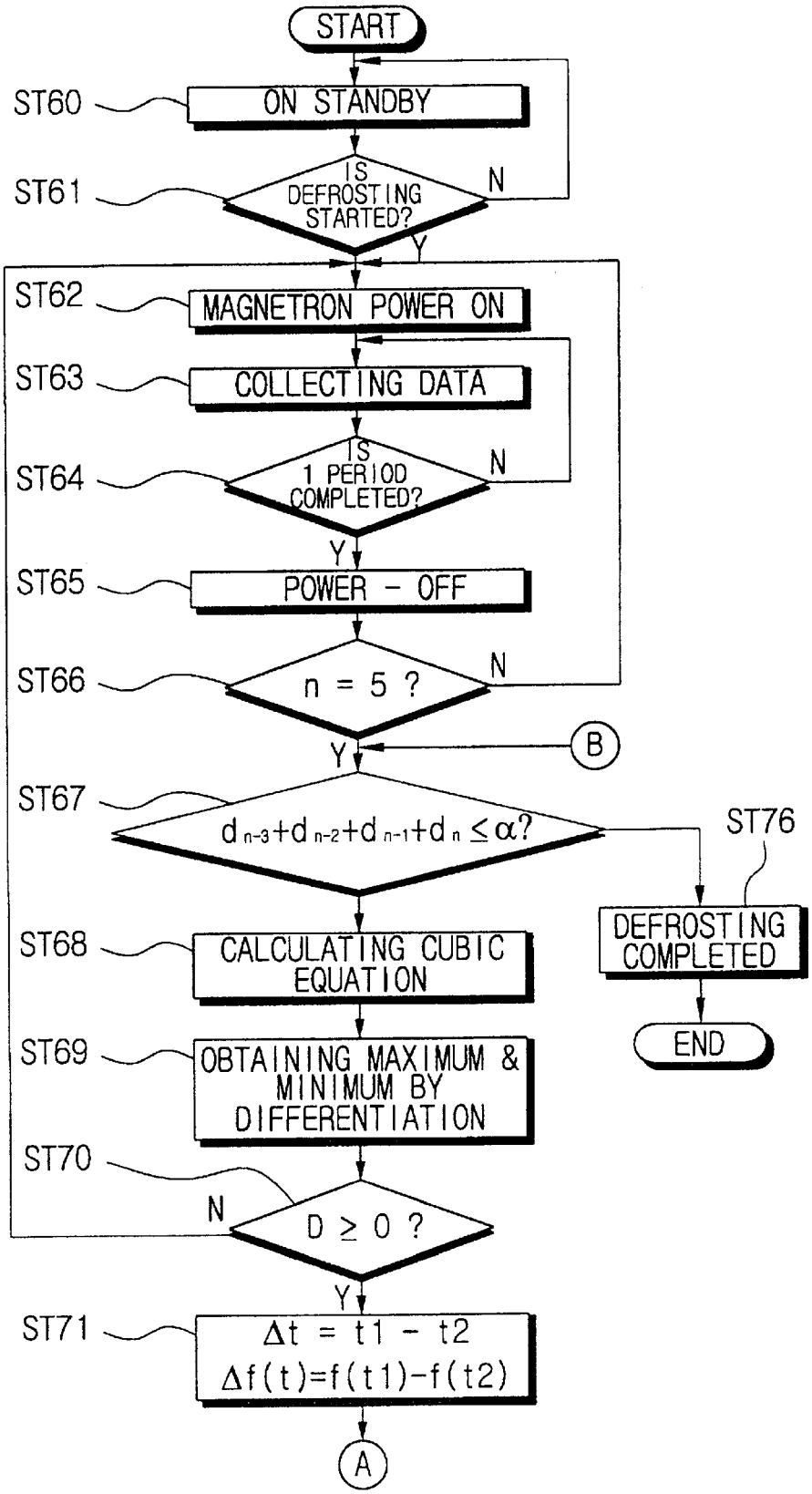
FIGS. 12A and 12B are flow charts for explaining a defrosting method for a microwave oven according to the fourth preferred embodiment of the present invention.
Figure 12B:
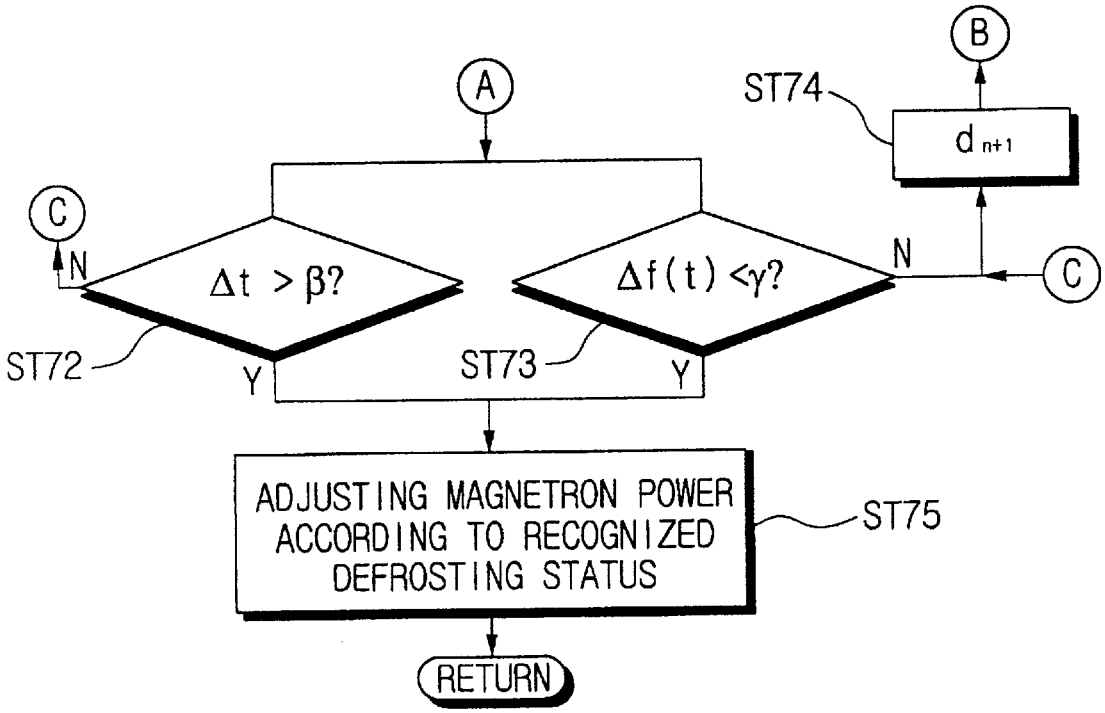

The method according to the fourth preferred embodiment of the present invention will be described in greater detail below with reference to the flow chart of FIG. 12.

First, in a state that the microwave oven is on standby for defrosting operation (step ST60), the microcomputer 12 determines whether there is a key input for defrosting operation execution from the key input section 2 (step ST61).

Upon determining the presence of key input for executing the defrosting operation, the microcomputer 12 controls the magnetron 18 to generate the microwaves of a predetermined degree for the defrosting operation. Also, the microcomputer 12 rotate the turntable 24 at a certain speed (step ST62).

In such a situation, the microcomputer 12 regularly receives the voltage signals about the cooking status of the food detected by the cooking status detecting sensor 6 from a certain detecting position through the voltage detecting section 8, and thus collects the data (step ST63).

Meanwhile, the microcomputer 12 determines whether the 1 turntable rotation period corresponding to three rotations of the turntable 24 is completed or not (step ST64).

When the microcomputer 12 determines the 1 turntable rotation period is completed, the microcomputer 12 powers-off the magnetron 18 (step ST65).

In such a situation, the microcomputer determines whether the turntable 24 is rotated for five turntable rotation periods or not (step ST66)

When determining the turntable 24 is rotated for five turntable rotation periods, the microcomputer 12 calculates the differences ($d_n$, $d_{n-1}$, $d_{n-2}$, $d_{n-3}$) between the detected data outputted from the respective turntable rotation periods, and sums the differences ($d_n$, ($d_{n-1}$, $d_{n-2}$, $d_{n-3}$) between the detected data outputted from the five respective turntable rotation periods.

Meanwhile, the microcomputer 12 determines whether the summation of the differences ($d_n$, $d_{n-1}$, $d_{n-2}$, $d_{n-3}$) between the detected data from the five turntable rotation periods is less than a predetermined value ($\alpha$) or not (step ST67).

When determining the summation of the differences ($d_n$, $d_{n-1}$, $d_{n-2}$, $d_{n-3}$) between the detected data outputted from the five turntable rotation periods is not less than the predetermined value ($\alpha$), the microcomputer 12 calculates the detected data from a plurality of turntable rotation periods by the cubic equation (step ST68).

Then, the microcomputer 12 calculates the points (t1 and t2) for local maximum and minimum by the differentiation of the cubic equation (step ST69).

Meanwhile, the microcomputer 12 determines whether the roots, i.e., the points (t1 and t2) calculated by the differentiation is imaginary root or not (step ST70).

When determining the points (t1 and t2) as the imaginary root, the microcomputer returns to the step ST62 to repeat the steps from ST62 to ST69.

When determining the points (t1 and t2) have two real roots or the multiple root, however, the microcomputer 12 obtains the time variation ($\Delta t$) by calculating the difference between the points (t1 and t2), and also obtains the data variation ($\Delta f(t)$) by calculating the difference between the value of function of point (t1) (i.e., f(t1): local maximum) and the value of function of point (t2) (i.e., f(t2): local minimum) (step ST71).

In such a situation, the microcomputer 12 determines whether the time variation ($\Delta t$) is greater than a predetermined time value ($\beta$) or not (step ST72).

Further, the microcomputer 12 determines whether the data variation ($\Delta f(t)$) is greater than a predetermined data value ($\gamma$) or not (step ST73).

Meanwhile, according to the determination of the steps ST72 and ST73, i.e., when the time variation ($\Delta t$) is greater than a predetermined time value ($\beta$), or when the data variation ($\Delta f(t)$) is less than a predetermined data value ($\gamma$), the microcomputer 12 adds one more turntable rotation period (step ST74), and returns to the step ST67 to repeat the steps from the step ST67 to step ST71.

When determining that the time variation ($\Delta t$) is greater than a predetermined time value ($\beta$), or when the data variation ($\Delta f(t)$) is greater than a predetermined data value ($\gamma$),the microcomputer 12 recognizes the type and weight of the defrosting food by the time and data variations ($\Delta t$ and $\Delta f(t)$), and adjusts the magnetron power according to the recognized status of the defrosting food (step ST75).

Here, when the determination of the step ST67 indicates that the summation of the differences ($d_n$, $d_{n-1}$, $d_{n-2}$, $d_{n-3}$) of the detected data outputted from the five turntable rotation periods is less than the predetermined value ($\alpha$), the microcomputer 12 recognizes the defrosting completion and accordingly completes the defrosting operation (step ST76).

As described above, according to the present invention, during the defrosting operation of the microwave oven, the microcomputer calculates the data of food in the microwave oven detected by a sensor, and accordingly adjusts the level of output power of magnetron and determines the defrosting completion time. Accordingly, regardless of various frozen status, weight, or size of the food, the user can perform the defrosting operation properly with one button manipulation for executing the defrosting operation of the microwave oven.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A defrosting method for a microwave oven, said microwave oven comprising a magnetron for generating microwave energy for defrosting foods in a cooking cavity within the microwave oven, said microwave energy generated by the magnetron at a level of output power capable of being varied, said microwave oven comprising a sensor device for measuring at least one physical parameter associated with a process of defrosting food in the cooking cavity and for providing output data representative of a measurement of said parameter, said method comprising the steps of:

(a) automatically detecting a change degree of output data from the sensor device for a predetermined time period; and (b) automatically adjusting the level of output power of the magnetron in accordance with the change degree of the output data from the sensor device, wherein said step (b) comprises a substep for variably adjusting the output power of the magnetron based on differences between output data from the beginning of a predetermined interval and output data from the end of the predetermined interval.

2. The defrosting method of claim 1, wherein the step (b) adjusts the output power of the magnetron in accordance with an absolute value of the change degree of the output data from the sensor device.

3. The defrosting method of claim 1, wherein the step (b) calculates ratio of the output data with respect to an initial output data and adjusts the level of output power of the magnetron in accordance with the differences calculated.

4. The defrosting method of claim 1, wherein the step (b) calculates a magnetron output power adjust range including the change degree of the output data from the sensor device therein, and adjusts the level of the power of the magnetron in accordance with the magnetron output power adjust range calculated.

5. The defrosting method of claim 1, wherein a rotatable turntable for supporting and rotating food to be defrosted is located in said cooking cavity; and the predetermined time period for which the output data are detected by the sensor device is measured in terms of a predetermined number of rotations of the turntable.

6. The defrosting method of claim 1, wherein the sensor device comprises an antenna sensor for detecting a magnetic field voltage of stationary waves of microwaves that the magnetron generates.

7. The defrosting method of claim 6, wherein the antenna sensor keeps detecting the magnetic field voltage from a magnetron power-on time until a magnetron power-off time.

8. The defrosting method of claim 1, wherein the level of the output power of the magnetron is adjusted by controlling an operation period of the magnetron by adding and subtracting magnetron power on/off periods in the step (b).

9. A defrosting method for a microwave oven, said microwave oven comprising a magnetron for generating microwave energy for defrosting foods in a cooking cavity within the microwave oven, said microwave energy generated by the magnetron at a level of output power capable of being varied, said microwave oven comprising a sensor device for measuring at least one physical parameter associated with a process of defrosting food in the cooking cavity and for providing output data representative of a measurement of said parameter, said method comprising the steps of:

(a) automatically detecting change degrees of output data from the sensor device for a predetermined time period;

(b) automatically calculating a slope of the output data detected for the predetermined time period, whereby a calculated slope value is provided; and (c) automatically determining a magnetron driving completion time by comparing the calculated slope value with a reference slope value.

10. The defrosting method of claim 9, wherein the step (c) comprises multiplying a plurality of slope values varying for the predetermined time period.

11. The defrosting method of claim 10, wherein the driving of magnetron is completed when a result of multiplication of the plurality of slope values is below a value of "0".

12. The defrosting method of claim 10, wherein the driving of the magnetron is continued by adjusting the level of output power of the magnetron when a result of multiplication of the plurality of slope values is above a value of "0".

13. The defrosting method of claim 10, wherein the driving of the magnetron is completed when a result of multiplication of the plurality of slope values equals a value of "0".

14. A defrosting method for a microwave oven, said microwave oven comprising a magnetron for generating microwave energy for defrosting foods in a cooking cavity within the microwave oven, said microwave energy generated at a level of output power capable of being varied, said microwave oven comprising a sensor device for measuring at least one physical parameter associated with a process of defrosting food in the cooking cavity and for providing output data representative of a measurement of said parameter, said method comprising the steps of:

(a) automatically detecting a change degree of output data from the sensor device for a predetermined time period; and (b) automatically determining a defrosting completion time in accordance with a predetermined function of the change degree of the output data detected for the predetermined time period.

15. The defrosting method of claim 14, wherein the step (b) determines a magnetron driving completion time in accordance with a summation of the change degrees of the data which the sensor device has detected for the predetermined time period.

16. The defrosting method of claim 14, wherein the step (b) calculates points for a local minimum and a local maximum of the detected data outputted for a predetermined time period; calculates the local minimum and the local maximum; and adjusts the magnetron power according to the difference between the points and the difference between the local minimum and maximum.

* * * * *